US006890202B2

(12) United States Patent
Yasufuku et al.

(10) Patent No.: US 6,890,202 B2
(45) Date of Patent: May 10, 2005

(54) CONNECTOR FOR MODULE

(75) Inventors: Kaori Yasufuku, Yokohama (JP); Taiji Hosaka, Yokohama (JP); Masaaki Miyazawa, Kawasaki (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/643,948

(22) Filed: Aug. 23, 2000

(65) Prior Publication Data

US 2002/0031948 A1 Mar. 14, 2002

(30) Foreign Application Priority Data

Dec. 28, 1999 (JP) ..... 11-375597

(51) Int. Cl.[7] ..... H01R 13/62

(52) U.S. Cl. ..... 439/331; 439/326

(58) Field of Search ..... 439/487, 485, 439/326, 331, 467, 492, 493, 499, 637, 607, 630, 636, 325; 361/701; 174/16.3

(56) References Cited

U.S. PATENT DOCUMENTS

| | | | | |
|---|---|---|---|---|
| 3,877,064 A | * | 4/1975 | Scheingold et al. | 439/487 |
| 4,298,237 A | | 11/1981 | Griffith et al. | |
| 4,314,311 A | | 2/1982 | Seytre et al. | |
| 4,761,140 A | * | 8/1988 | Geib | 439/331 |
| 4,806,103 A | | 2/1989 | Kniese et al. | |

(Continued)

FOREIGN PATENT DOCUMENTS

| | | |
|---|---|---|
| GB | 1564928 | 4/1980 |
| JP | 11-329561 | 5/1998 |
| JP | 11111392 A | 4/1999 |
| TW | 313352 A | 8/1997 |
| WO | WO 97/43805 A | 11/1997 |

OTHER PUBLICATIONS

Search Report, Taiwan Patent Office, Appl 11–375,734, Dec. 28, 1999, 3 pages.
European Patent Office, Nov. 26, 2002, 3 pages.
Inventors: Kaori Yasufuku et al., "Cap and Low Insertion Force Connector for Printed Circuit Board", Filed: Aug. 23, 2000, Specification & Drawings of U.S. Appl. No. 09/643, 963.
Inventors: Kaori Yasufuku et al., "Connector for Module", Issued: Aug. 21, 2001, U.S. Appl. No. 6,278,610.

(Continued)

*Primary Examiner*—P. Austin Bradley
*Assistant Examiner*—Felix O. Figueora
(74) *Attorney, Agent, or Firm*—Nixon Peabody LLP; Donald R. Studebaker

(57) ABSTRACT

A connector for module that connects a module to a printed circuit board in a position wherein the board plane of the module is approximately parallel to the printed circuit board. This connector for module comprises a connector body having a receiving part that extends along the front side of a module being in the connection position and is provided in the rear face thereof with a groove into which the front side of the module is to be inserted, having a contact that is provided in the groove of the receiving part and contact a conductive pad while allowing the pad to shift in the direction of insertion/withdrawal when the module is in the insertion/withdrawal position in which the rear side is at a higher level than in the connection position, and having a supporting part that extend rearward from the receiving part to support both the left and right sides and the bottom of the module being in the connection position, and a metallic cover that is put over and is engaged to the connector body to sandwich the module between itself and the supporting part and keep the module in the connection position. This connector for module prevents defective connection and disconnection of the modules due to thermal load and elastic deformation. The connector for module reduces the effects of electromagnetic waves, etc. on the connector for module and the module to stably maintain the operation of the circuit.

20 Claims, 23 Drawing Sheets

U.S. PATENT DOCUMENTS

| | | | | | |
|---|---|---|---|---|---|
| 4,978,638 | A | * | 12/1990 | Buller et al. | 439/487 |
| 5,109,980 | A | * | 5/1992 | Matsuoka et al. | 439/331 |
| 5,161,087 | A | | 11/1992 | Frankeny et al. | |
| 5,174,780 | A | | 12/1992 | Yang Lee | |
| 5,648,890 | A | * | 7/1997 | Loo et al. | 361/704 |
| 5,757,622 | A | | 5/1998 | Tanaka et al. | |
| 5,761,036 | A | * | 6/1998 | Hopfer et al. | 439/487 |
| 5,769,668 | A | * | 6/1998 | Tondreault | 439/326 |
| 6,188,576 | B1 | | 2/2001 | Ali et al. | |
| 6,246,583 | B1 | * | 6/2001 | Cronin et al. | 361/704 |
| 6,308,772 | B1 | * | 10/2001 | Obara et al. | 361/704 |
| 6,362,966 | B1 | | 3/2002 | Ali et al. | |

OTHER PUBLICATIONS

First Office Action from People Republic of China for Appl. No. 00130971.4 dated Oct. 1, 2004 (with translation).

First Office Action from People Republic of China for Appl. No. 00130968.4 dated Oct. 15, 2004 (with translation).

European Search Report for European Application No. EP 00118667.5.

First Office Action from the Peoples of China for Application No. 00130970.6 dated Nov. 19, 2004.

* cited by examiner

CONNECTOR FOR MODULE

BACKGROUND OF THE INVENTION

1. Field of the Invention

The present invention belongs to a technical field of connector for module (hereinafter it may be simply referred to as connector) that is used for a module wherein semiconductor chips are mounted on a rectangular board and conductive pads are provided on a front edge of the board (hereinafter simply referred to as module). In particular, the present invention relates to countermeasures against heat, electromagnetic waves, etc. to which a connector for module is exposed.

2. Related Art

Modules of this kind include those in which semiconductor chips such as semiconductor memories are mounted. A module connector is used extensively, which connects a module of this kind to a printed circuit board such as a mother board in a position wherein the board surface of the module is approximately parallel to the printed circuit board. This connector has an approximately U-shaped form to correspond to the front side, left side and right side of the module, respectively. A receiving part of the connector corresponding to the front side is provided with a groove that will receive the front side of the module. The groove is provided with contacts that will contact conductive pads while allowing the conductive pads to move in a direction of insertion/withdrawal when the module is in an insertion/withdrawal position in which the rear side thereof is lifted more in comparison with its level in the connection position. Two arms of the connector corresponding to the left side and the right side of the module are arranged so that their top ends can undergo elastic deformation leftward and rightward, respectively, and each arm is provided with a engaging claw on the inner side of the top end thereof. The connector is mounted on the printed circuit board by soldering the solder tails of the contacts onto the printed circuit board and, when necessary, fixing its arms on the printed circuit board. When the module is to be fitted into the connector, first, the module is set in the insertion/withdrawal position and the front side of the module is put into the groove of the receiving part; in this way, the front side is inserted between the contacts. Next, the rear side of the module is pushed downward. As a result, the conductive pads and contacts are made to contact with each other. When the left side and the right side are pressed against the arms, the top ends of the arms will undergo elastic deformation outward and the engaging claws will fit into the left side and the right side of the module. As a result, the module will be retained in the connection position. When the fitted module is to be disconnected from the connector, the top ends of the arms are made by fingers to undergo elastic deformation outward to release the engaging claws from the module. The rear side of the module will be lifted by the elastic recovering forces of the contacts and the module will be shifted from the connection position into the insertion/withdrawal position. Thus the module can be withdrawn from the receiving part of the connector.

Semiconductor memories show a tendency to increase their heat generation significantly. It is due to quickening of their operating speed that is a result of the speed-up of the CPU. This thermal load may cause deformation of the arms of the connector, which in turn results in loss of the engaging function of the engaging members. Outward elastic deformation of the top ends of the arms by fingers may cause plastic deformation of the arms. The loss of the engaging function and the deformation may cause defective connection and/or disconnection of the module. Heat generation also poses a problem that it may make the operation of the semiconductor memories unstable. Moreover, if the connector and the module are exposed to the effects of ambient electromagnetic waves or the like, the operation of the circuits may become unstable. The above-mentioned problems are not limited to the connectors for modules having semiconductor memories. They are common to connectors for modules having semiconductor chips.

SUMMARY OF THE INVENTION

One objective of the present invention is to prevent defective connection and disconnection of the module due to thermal load on the connector body and its elastic deformation by reinforcing the connector body with a metallic cover, and to reduce effects of electromagnetic waves or the like on the connector for module and the module and keep the operation of the circuit stable by covering and shielding the connector with the metallic cover.

The connector for module according to the present invention is a connector for module that connects a module, which has a semiconductor chip mounted on a rectangular board and has a conductive pad on the front side of the board, to a printed circuit board in a position wherein the board plane is approximately parallel to the printed circuit board. This connector for module comprises:

a connector body having a receiving part that extends along the front side of the module being in the connection position and is provided in the rear face thereof with a groove into which the front side of the module is to be inserted, having a contact that is provided in the groove of the receiving part and contacts the conductive pad while allowing the pad to shift in the direction of insertion/withdrawal when the module is in the insertion/withdrawal position in which the rear side is at a higher level than in the connection position, and having a supporting part that extends rearward from the receiving part to support both the left and right sides and the bottom of the module being in the connection position; and a metallic cover that is put over and is engaged to the connector body to sandwich the module between itself and the supporting part and keep the module in the connection position.

This connector for module is mounted on a printed circuit board by, for example, soldering the solder tail of the contact onto the printed circuit board and, when necessary, fixing the supporting part onto the printed circuit board. When a module is to be fitted into the connector, first, the module is set in the insertion/withdrawal position and the front side of the module is put into the groove of the receiving part; thus the front side is inserted to the contact. Next, the metallic cover is put over the module and the metallic cover is pressed down. As a result, the rear side of the module will be pressed down and the conductive pad will come into contact with the contact. Further, when the metallic cover is put over the connector body and engaged to it, the module will be sandwiched between the supporting part and the metallic cover and kept in the connection position. When the module is to be disconnected from the connector, first, engagement of the metallic cover to the connector body is undone. As a result, the rear side of the module will be lifted up by the elastic restoring force of the contact and the module will be shifted from the connection position into the insertion/withdrawal position. Then the module can be withdrawn from the contact.

In this case, even if the connector is subjected to thermal load from the semiconductor chip, as the connector body is reinforced by the metallic cover and as the thermal load to the connector body is reduced by the heat-dissipating effect of the metallic cover, the connector body will be hardly deformed. Furthermore, as the retaining structure is designed to sandwich the module between the metallic cover and the supporting part, even if the connector is subjected to thermal loads, the retaining force for the module will be hardly affected. Thus the connector can retain the module reliably. Moreover, as the connector body has no parts that are subjected to elastic deformation by manipulation, the connector body will not be damaged. Thus the module can be retained in the connection position reliably. Accordingly, even if the heat generation of semiconductor chip of the module increases significantly, defective connection and disconnection of the module can be prevented. As the metallic cover covers the connector body and the module, the cover exhibits its shielding function to reduce the effects of electromagnetic waves or the like on the connector for module and the module. Thus the stable operation of the circuit can be maintained.

BRIEF DESCRIPTION OF THE DRAWINGS

FIG. 18A is a perspective view, and FIG. 18B is a magnified view of a protrusion of the connector body and a guide groove of the cover.

FIG. 19A is a perspective view, and FIG. 19B is a magnified view of a protrusion of the connector body and a guide groove of the cover.

PREFERRED EMBODIMENTS OF THE INVENTION

Figure 1:
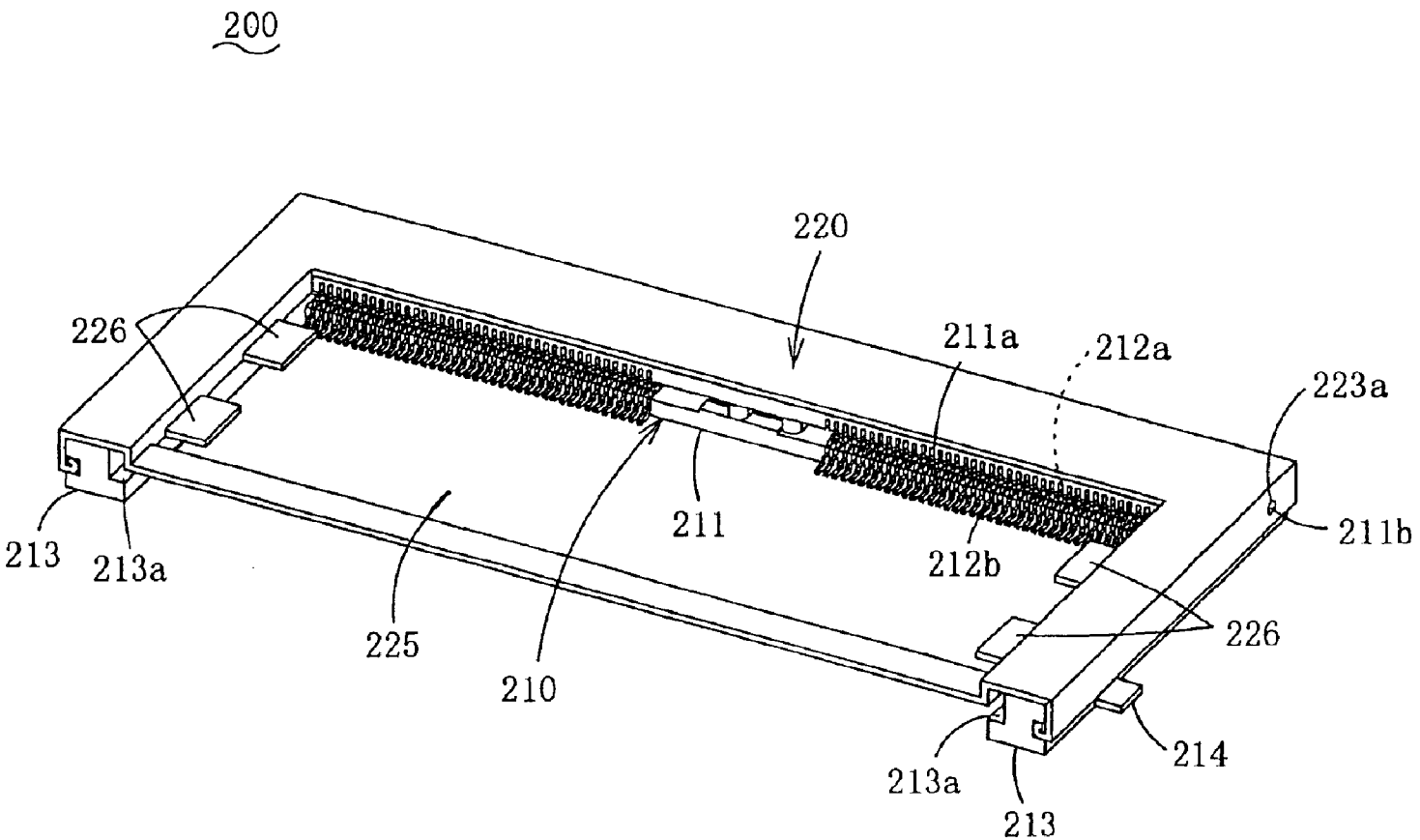
FIG. 1 is a perspective view showing the first embodiment of the connector.
Figure 2:
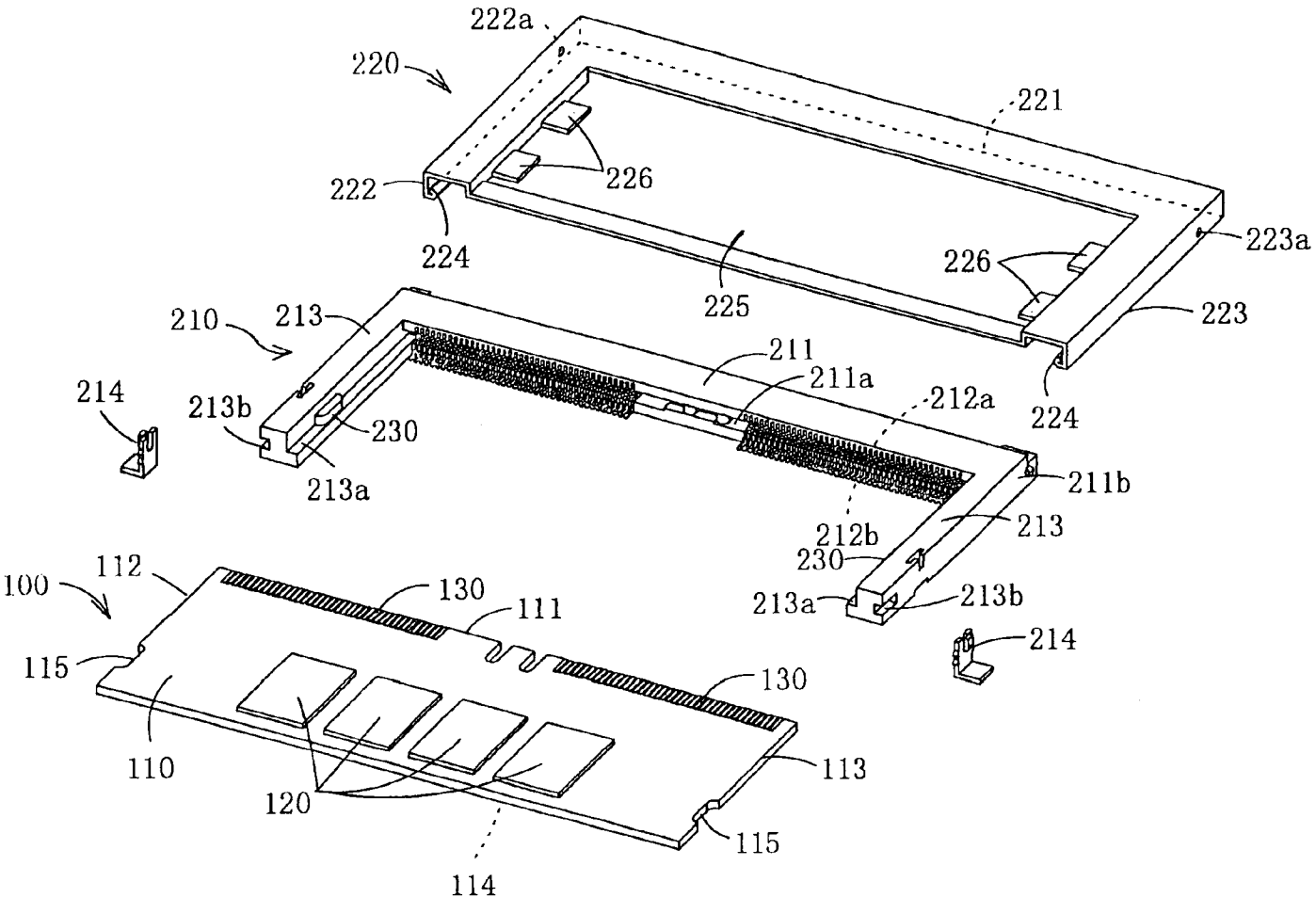
FIG. 2 is a perspective view showing the first embodiment of the connector, which is disassembled into a connector body and a metallic cover, together with a module.

In the following, some embodiments of the connector for module according to the present invention will be described. Each embodiment will be described by using a system of directions that is based on the directions to the front, to the rear, to the left, to the right, to the top, and to the bottom, respectively. This system of directions is used only for the connector just to facilitate the description. The system of directions is not related to the actual directions of the printed circuit board on which the connector is mounted and the device in which the printed circuit board is mounted.

FIG. 1 through FIG. 6 show the first embodiment of the connector. In these diagrams, 100 denotes a module. The module 100 is provided with a rectangular board 110, on which semiconductor chips 120 such as semiconductor memories are mounted, and conductive pads 130, which are connected to the above-mentioned semiconductor chips 120, etc., are provided on the front side 111 of the board 110. The conductive pads 130 are made of conductors and are provided on the face and the back of the board 110. In addition to this, the present invention covers a module wherein conductive pads are provided only on the face of the front side of the board, and a module wherein conductive pads are provided only on the back of the front side of the board. For the convenience of description, the marks that are used for the front side, side faces, bottom, etc. of the board 110 are also used for the front side, side faces, bottom, etc. of the module 100.

Figure 3A:
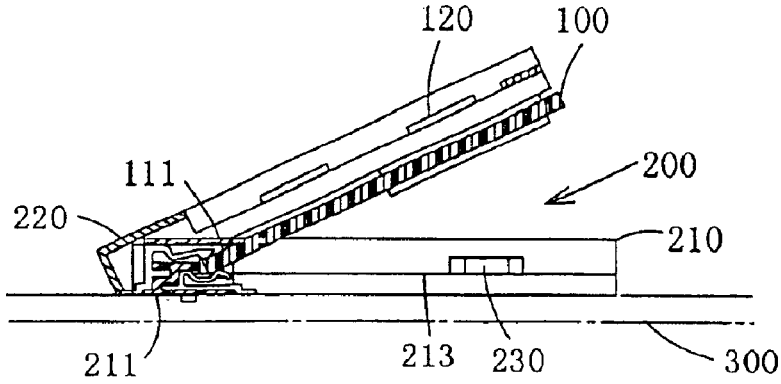
FIG. 3A is a sectional view showing the first embodiment of the connector with the module being kept in the insertion/withdrawal position.
Figure 3B:
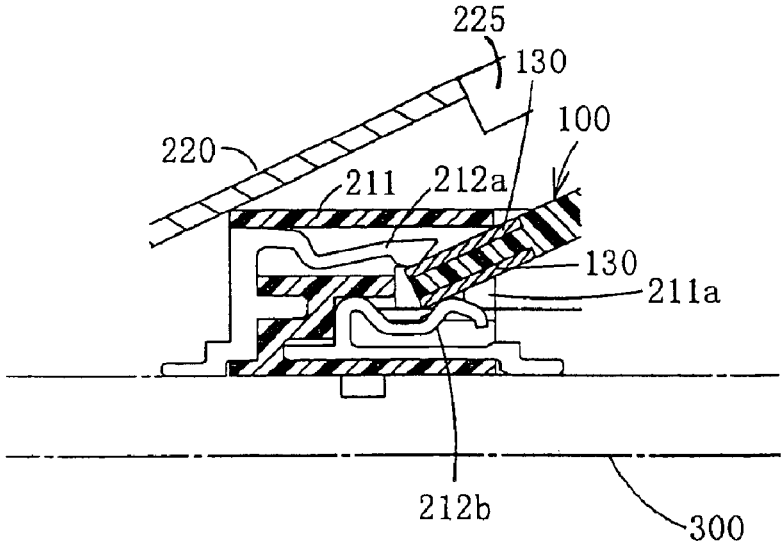
FIG. 3B is a partially magnified view of FIG. 3A.
Figure 4A:
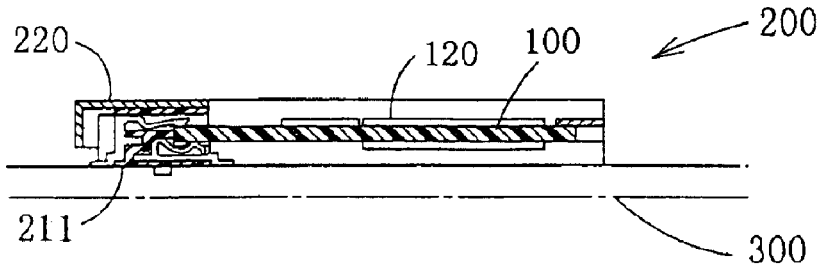
FIG. 4A is a sectional view of the first embodiment of the connector with the module being kept in the connection position.
Figure 4B:
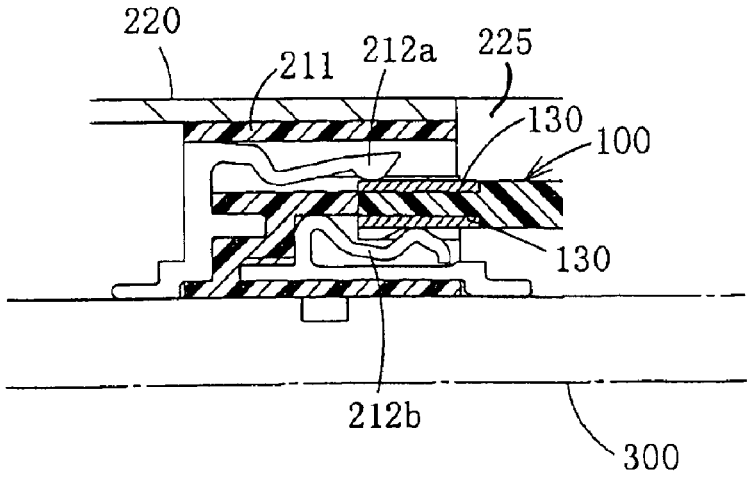
FIG. 4B is a partially magnified view of FIG. 4A.
Figure 5:
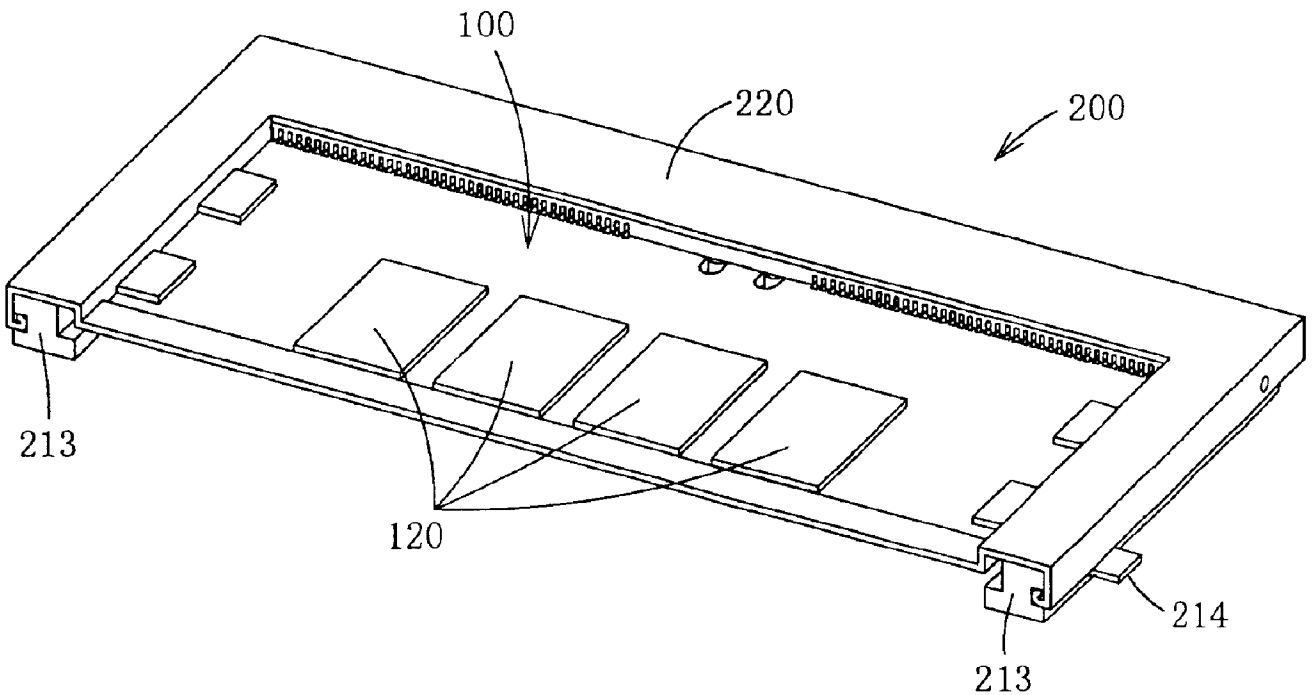
FIG. 5 is a perspective view showing the first embodiment of the connector with the module fitted.
Figure 6:
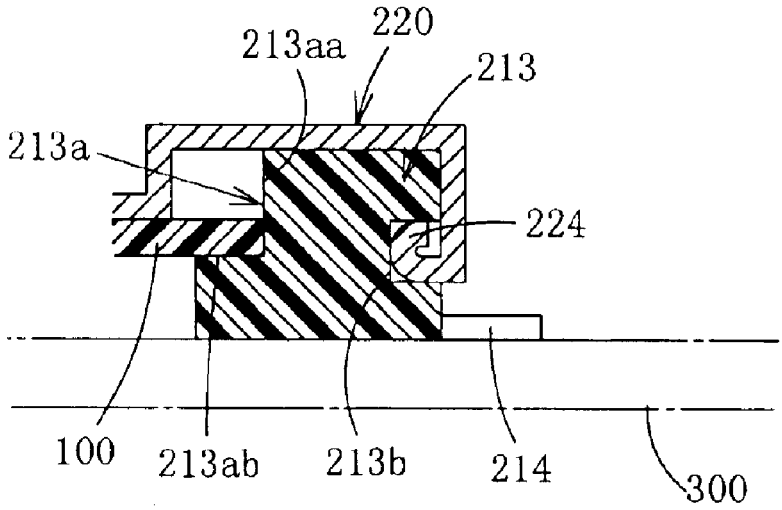
FIG. 6 is a sectional view of one supporting part, which is in the state of FIG. 3A, along a plane that faces the front and the rear.

200 denotes a connector for module that connects the above-mentioned module 100 to a printed circuit board 300 such as a mother board. As shown in FIG. 4A and FIG. 4B, the module 100 is fitted in the connector 200 in a position in which the plane of the module 100 is approximately parallel to the printed circuit board 300. As shown in FIG. 3A and FIG. 3B, insertion of the module 100 into the connector 200 and its withdrawal from the connector 200 are made, as shown in FIG. 3A and FIG. 3B, in the insertion/withdrawal position wherein the rear side of the module 100 is raised more than in the connection position and the plane of the module 100 is oblique to the printed circuit board 300. The connector 200 is provided with a connector body 210. This connector body 210 has a receiving part 211 that extends along the front side 111 of the module 100 being in the connection position, and supporting parts 213 that extend rearward from the receiving part 211 to support the left side 112, the right side 113 and the bottom 114 of the module 100 being in the connection position.

The rear of the receiving part 211 is provided with a groove 211*a* into which the front side 111 of the module 100 is to be inserted. This groove 211*a* is provided with contacts 212*a*, 212*b*, which contact the conductive pads 130 on both the face and back of the module 100 being in the insertion/withdrawal position while allowing the module 100 to shift in a direction of insertion/withdrawal thereof. The contacts 212*a*, 212*b* are arranged on an upper side and a lower side in the groove 211*a*, and the contacts 212*b* on the lower side are staggered rearward relative to the contacts 212*a* on the upper side. As shown in FIG. 3A and FIG. 3B, the module 100 is allowed to shift in the insertion/withdrawal direction when it is in the insertion/withdrawal position. As shown in FIG. 4A and FIG. 4B, when the module 100 is set in the connection position, the conductive pads 130 and the contacts 212*a*, 212*b* will contact with each other. For a module wherein conductive pads are provided only on the face of the front side of the board, contacts may be provided only on the upper side. For a module wherein conductive pads are provided only on the back of the front side of the board, contacts may be provided only on the lower side.

In this embodiment, supporting parts 213 are two, one at the left and the other at the right. The two supporting parts 213 extend rearward along the left side and the right side of the module 100, respectively. A stepped part 213*a* is formed on the inner side of the above-mentioned supporting members 213. The stepped parts 213*a* have corners that have an L-shape or an inverted-L-shape when seen from the rear. The left and right vertical faces 213*aa* of the stepped parts 213*a* support the left side 112 and the right side 113 of the module 100 being in the connection position, and the horizontal faces 213*ab* support the bottom 114 of the module 100 in the connection position. When necessary, reinforcing tabs 214 being made of, for example, a metal, are fixed to the supporting parts 213. These reinforcing tabs 214 are fixed onto the printed circuit board 300 by soldering, etc. The present invention includes an embodiment wherein the supporting part is not divided into the left and right ones but the supporting part is formed integrally and extends rearward from the receiving part along the left side, the right side and the bottom of the module being in the connection position. In this case, the above-mentioned supporting member has a stepped part that looks a concave when seen from the rear, and the right and left vertical faces of this stepped part receive the left side 112 and the right side 113 of the module being in the connection position, and the horizontal face between the left and right vertical faces support the bottom of the module being in the connection position.

This connector 200 is provided with a metallic cover 220. This metallic cover 220 covers the connector body 210 and is engaged to it, and the metallic cover 220 and the supporting parts 213 sandwich the module 100 to retain it in the connection position. A front face supporting part 221, a left side supporting part 222 and the right side supporting part 223 hang from the front edge, left edge and right edge of the metallic cover 220 along the front of receiving part 211, the left side and the right side of the supporting parts 213, respectively. Of these supporting parts, provision of the front supporting part 221 is discretionary. It, however, is preferable to provide the front supporting part 221 so as to enhance the shielding effect. The metallic cover 220 is hinged to the receiving part 211 at the front, and this allows the metallic cover 220 to lift its rear end. The hinged connection is realized by, for example, fixing cylindrical protrusions 211*b* on the left side and the right side of the receiving part 211 and making these protrusions 211*b* pierce holes 222*a*, 223*a* that are opened in the left side supporting part 222 and the right side supporting part 223 of the metallic cover 220. Securing hooks 224 are formed at the rear ends of the left side supporting part 222 and the right side supporting part 223 of the metallic cover 220 by, for example, bending the lower ends inward. When the metallic cover 220 is placed over the connector body 210, the securing hooks 224 will fit into the securing holes 213*b* that are concavely formed in the outer sides of the rear ends of the supporting parts 213. This will secure the metallic cover 220 to the connector body 210. A window 225 is opened in the center of the metallic cover 220 to expose semiconductor chips 120 of the module 100 being in the connection position. Tabs 226 are provided on the inner edges of the window 225 so that the tabs 226 contact the top of the board 110 of the module 100 being in the connection position. In this embodiment, the tabs 226 and a part that is on the rear side of the window 225 of the metallic cover 220 and is lower than the rest are in contact with the module 100, and this contacting parts transmit the sandwiching force of the metallic cover 220 to the module 100. The contacting part for the module 100, however, may be set at any part or parts of the metallic cover 220. The present invention includes an embodiment wherein there is no rear side of the inner edge of the window thus the window is open to the rear.

The connector body 210 or the metallic cover 220 is provided with a positioning mechanism that will position the module 100 in the front-rear direction when the module 100 comes into the connection position. In the first embodiment, positioning protrusions 230 protruding inward are provided on the vertical faces 213*aa* of the stepped parts 213*a* of the supporting parts 213. When the module 100 gets into the connection position and these positioning protrusions 230 fit into notches 115 that are notched in the left side 112 and the right side 113 of the module 100, the module 100 will be positioned in the front-rear direction. The positioning protrusions may be provided on the metallic cover.

The connector for module of the first embodiment is mounted on a printed circuit board 300 by, for example, soldering the solder tails of contacts 212*a*, 212*b* onto the printed circuit board 300 and fixing the supporting parts 213 to the printed circuit board with reinforcing tabs 214, etc. when required. When the module 100 is to be fitted into the connector 200, the module 100 is set in the insertion/withdrawal position as shown in FIG. 3A and FIG. 3B, and the front side 111 is inserted into the groove 211*a* of the receiving part 211. As a result, the front side 111 will be inserted between the contacts 212*a*, 212*b*. Next, the metallic cover 220 is placed over the module 100 and pressed downward. The rear side of the module 100 will be pushed down and the conductive pads 130 and the contacts 212*a*, 212*b* will come to contact with each other. Next, the metallic cover 220 is set over and engaged to the connector body 210. As a result, as shown in FIG. 4A and FIG. 4B, the module 100 will be sandwiched between the supporting members 213 and the metallic cover 220 and kept in the connection position. In this case, positioning of the module 100 in its top-bottom direction is effected by the metallic cover 220 and the horizontal faces 213*ab* of the supporting members 213, and positioning of the module in its left-right direction is effected by the left and right vertical faces 213*aa* of the supporting members 213; thus the module 100 is kept in the connection position. When the module 100 is to be removed from the connector 200, the metallic cover 220 is pulled up to undone the engagement to the connector body 210. As a result, the rear side of the module 100 will be lifted up by the elastic restoring forces of the contacts 212*a*, 212*b* and shifted from the connection position into the insertion/withdrawal position. Then the module 100 can be withdrawn from the contacts 212*a*, 212*b*.

In this case, even when the connector 200 is exposed to thermal loads of the semiconductor chips 120, the connector body 210 will be hardly deformed because the connector body 210 is reinforced by the metallic cover 220 and the thermal load to the connector body 210 is reduced by the heat dissipating effect of the metallic cover 220. Moreover, as the retention structure is designed to sandwich the module 100 between the metallic cover 220 and the supporting parts 213, the forces for retaining the module 100 will be hardly affected even if the retention structure is subjected to thermal loads. Thus the module 100 can be retained reliably. Further, as the connector body 210 has no parts that are to be elastically deformed by manipulation, the connector body 210 will not be damaged by manipulation and the module 100 will be kept in the connection position reliably. Accordingly, defective connection and disconnection can be prevented. As the metallic cover 220 covers the conductive members such as the contacts 212*a*, 212*b* of the connector body 210 and the conductive pads 130 of the module 100 to exhibit its shielding function, effects of any electromagnetic waves, etc. on the connector 200 and the module 100 will be reduced, and in turn, the operation of the circuits will be maintained stably. When the supporting parts 213 are fixed onto the printed circuit board 300 by means of metallic reinforcing tabs 214, the metallic cover 220 may be arranged to come into contact with the reinforcing tabs 214 when the metallic cover 220 is engaged to the connector body 210. In this way, a circuit will be completed, which grounds the metallic cover 220 via the reinforcing tabs 214. This can enhance the shielding performance of the metallic cover 220.

The present invention include all embodiments wherein the connector is provided with a metallic cover that is placed over and engaged to the connector body on the module side. However, like the first embodiment, if the metallic cover 220 is hinged to the receiving part 211 at the front thereof so that the rear end of the metallic cover 220 can be lifted up, the metallic cover 220 will be engaged to the connector body 210 when the rear end of the metallic cover 220 is pushed down, and the metallic cover 220 will be disconnected from the connector body 210 when the rear end of the metallic cover 220 is pushed up. Thus shifting of the module 100 between the insertion/withdrawal position and the connection position can be done easily with a single touch.

The present invention includes embodiments wherein no positioning mechanism is provided for positioning the module in the front-rear direction when the module is get into the connection position. However, like the first embodiment, if the connector body 210 or the metallic cover 220 is provided with a positioning mechanism of this kind 230, the module 100 will be kept more accurately in the connection position since the positioning of the module 100 in the up-down direction will be made by the metallic cover 220 and the horizontal faces 213*ab* of the supporting members 213, the positioning of the module 100 in the left-right direction will be made by the vertical faces 213*aa* of the supporting members 213, and in addition to them, positioning in the front-rear direction will be made by the positioning mechanism 230.

Figure 7:
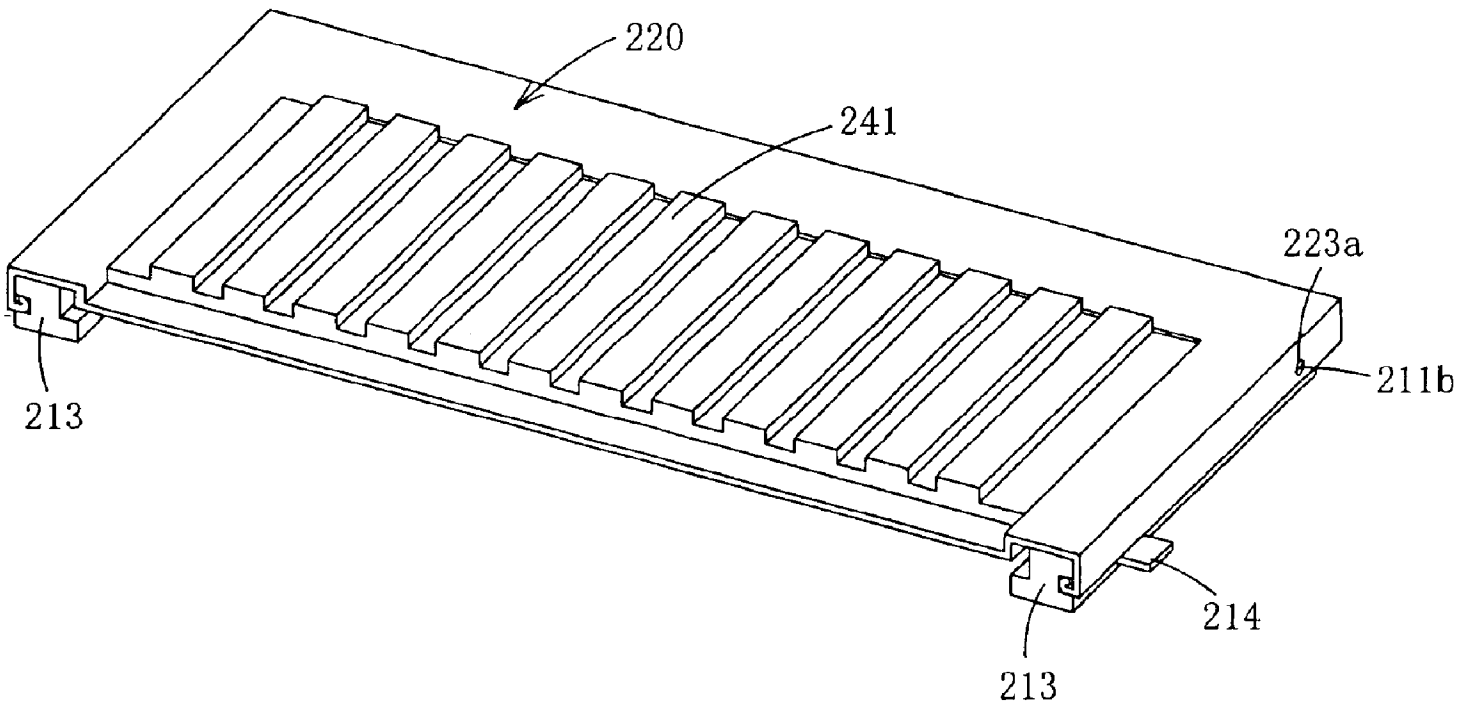
FIG. 7 is a perspective view of the second embodiment of the connector.
Figure 8:
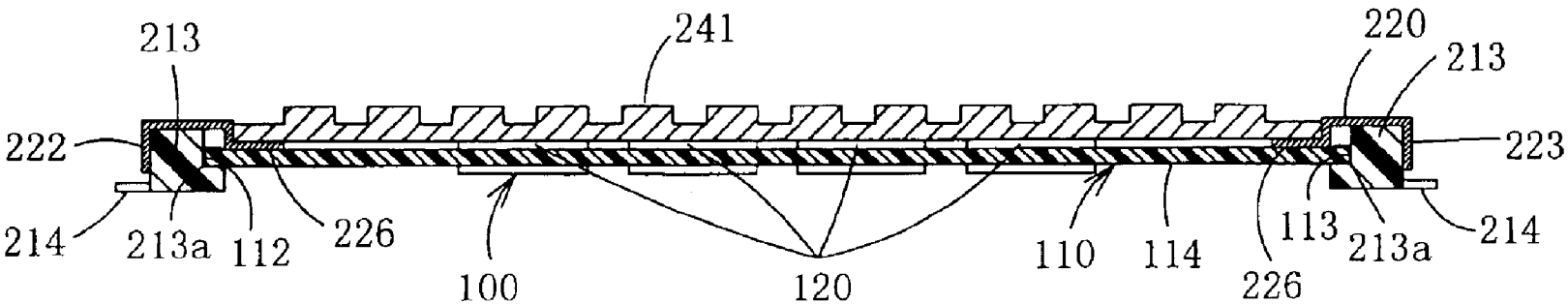
FIG. 8 is a sectional view of the second embodiment of the connector with the module fitted.
Figure 9:
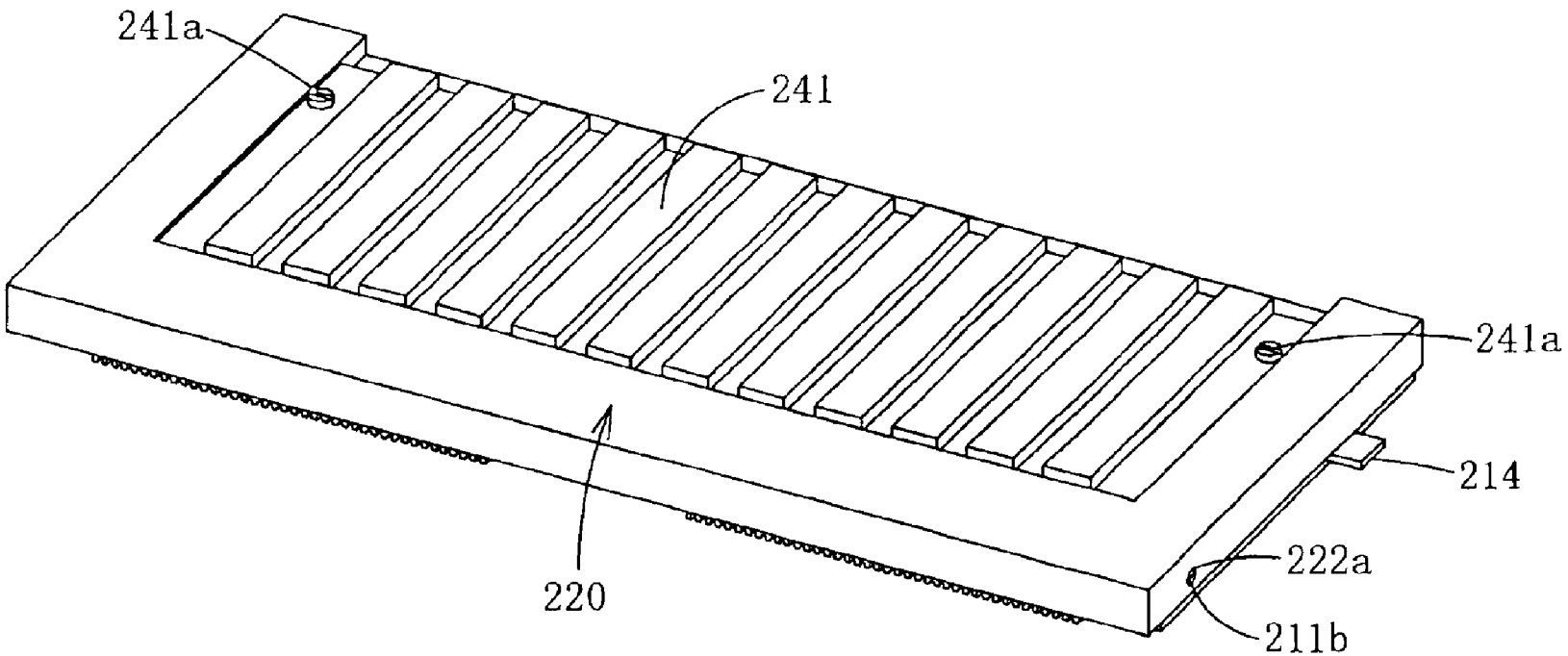
FIG. 9 is a perspective view of the third embodiment of the connector.

Next, other embodiments will be described. The description of the first embodiment will be cited in tact for other embodiments and only points that differ from the first embodiment will be described in the following. Further, of the functions and desirable effects of other embodiments, which have been described for the first embodiment, will not be described repeatedly. FIG. 7 and FIG. 8 show the second embodiment. In this second embodiment, a window 225 is opened in the metallic cover 220, which exposes the semiconductor chips 120 of the module 100 being kept in the connection position. A heat sink 241 is connected to the metallic cover 220 and the heat sink 241 contacts the above-mentioned semiconductor chips 120 in the window 225. The heat sink 241 is a heat-dissipating board that is excellent in heat dissipation. In this embodiment, the inner edges of the window 225 are provided with tabs 226 so that these tabs 226 will come to contact with the top of the board 110 of the module 100 being in the connection position. The bottom of the heat sink 241 is fixed to the tabs 226 by means of an adhesive, etc. Connection of the heat sink 241 to the metallic cover 220 may be effected by other methods. For example, in the third embodiment as shown in FIG. 9, the heat sink 241 is screwed to tabs 226 by means of screws 241*a*.

With the arrangements of the second embodiment and the third embodiment, when the module 100 is in the connection position, heat of the semiconductor chips 120 is conducted to the heat sink 241 to facilitate heat dissipation. As a result, the semiconductor chips 120 will be cooled and their performance will be maintained stably. Further, the metallic cover 220 and the heat sink 241 cover the contacts 212*a*, 212*b* of the connector body 210, conductive pads 130 and semiconductor chips 120 of the module 100 to exhibit the shielding functions, effects of electromagnetic waves, etc. on the connector 200 and the module 100 will be reduced to stably maintain the performance of the circuits.

Figure 10:
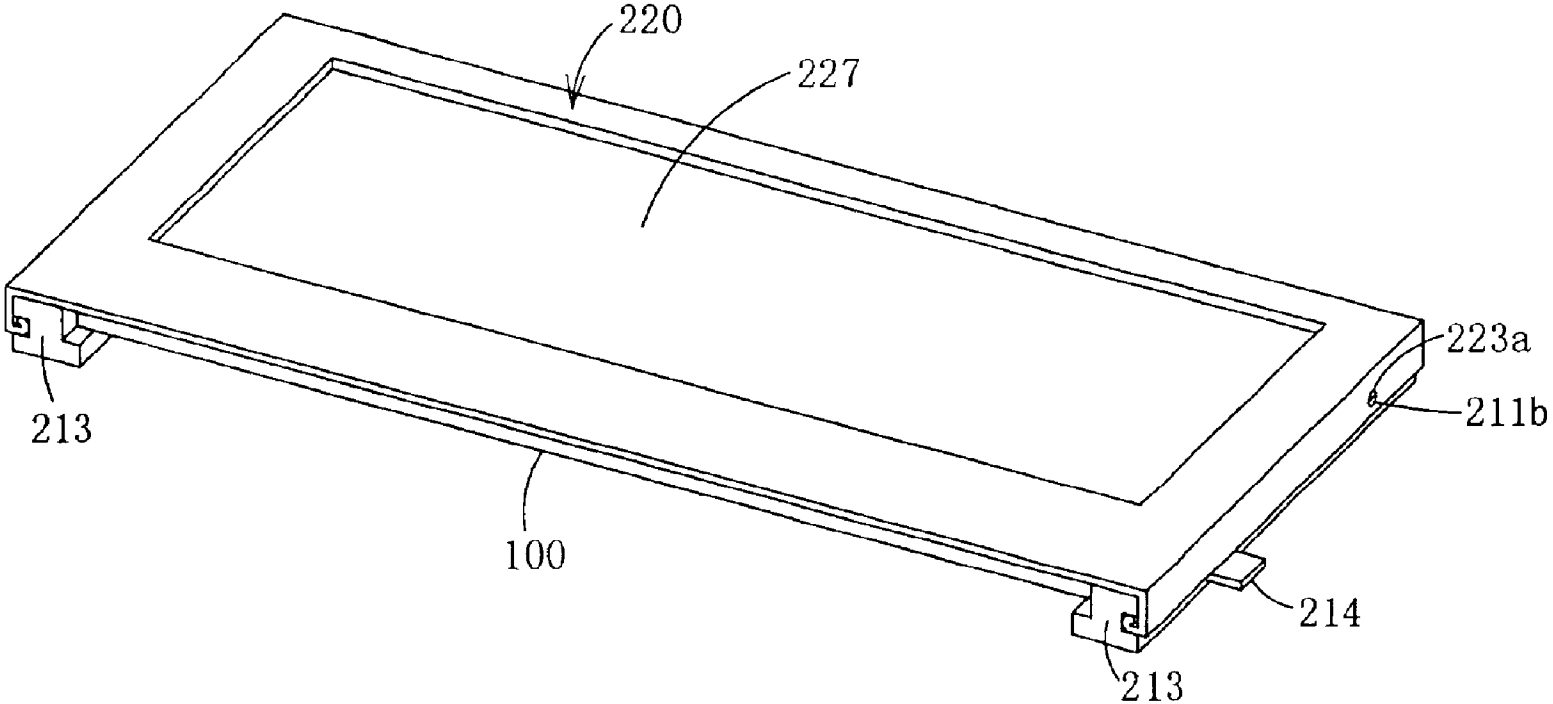
FIG. 10 is a perspective view showing the fourth embodiment of the connector with a module fitted.
Figure 11:
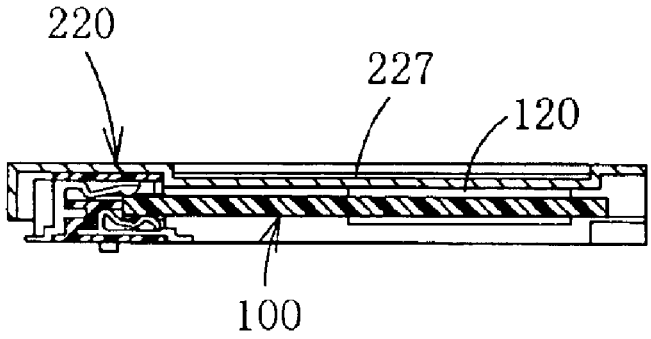
FIG. 11 is a sectional view of the fourth embodiment of the connector with the module fitted.

FIG. 10 and FIG. 11 show the fourth embodiment. In this fourth embodiment, the metallic cover 220 is provided with a contacting part 227 that contacts the semiconductor chips 120 of the module 100 being in the connection position. In this embodiment, the contacting part 227 is formed by concaving the central part of the metallic cover 220 while keeping the central part flat, and the bottom of this contacting part 227 is brought into contact with the semiconductor chips 120.

With the arrangement of the fourth embodiment, when the module 100 is in the connection position, heat of the semiconductor chips 120 will be transmitted via the contacting part 227 to the entire metallic cover 220 and heat dissipation will be accelerated. As a result, the semiconductor chips will be cooled and its operation will be maintained stably. Further, as the metallic cover 220 covers the contacts 212*a*, 212*b* of the connector body 210, and the conductive parts such as the conductive pads 130 and semiconductor chips 120 of the module 100 to exhibit the shielding function, effects of electromagnetic waves, etc. on the connector 200 and the module 100 will be reduced and the operation of the circuits will be maintained stably.

Figure 12:
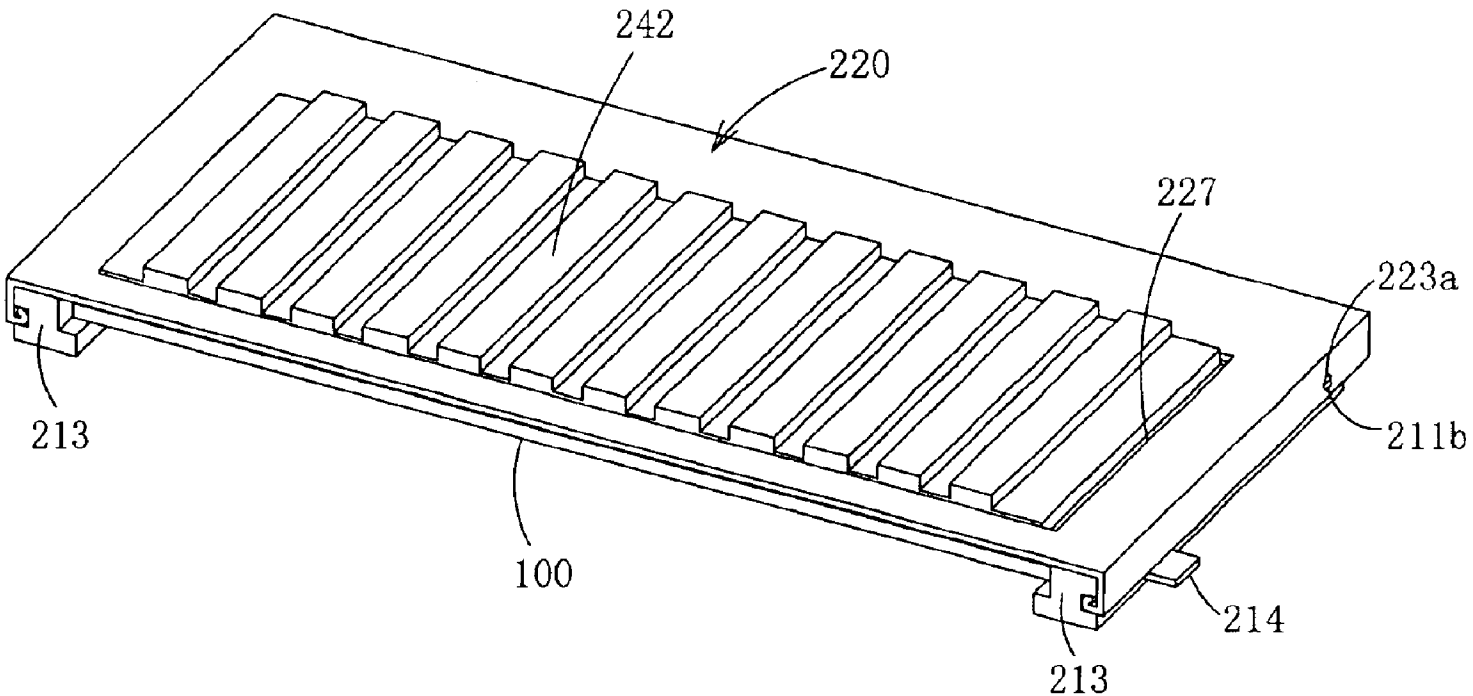
FIG. 12 is a perspective view of the fifth embodiment of the connector with a module fitted.
Figure 13:
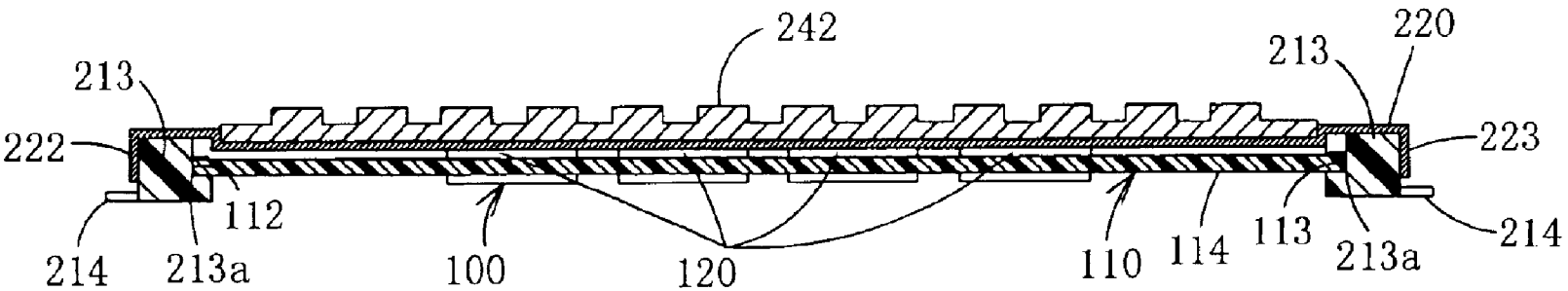
FIG. 13 is a sectional view of the fifth embodiment of the connector with the module fitted.

FIG. 12 and FIG. 13 show the fifth embodiment. In this fifth embodiment, like the fourth embodiment, the metallic cover 220 is provided with a contacting part 227 that will contact the semiconductor chips 120 of the module 100 being in the connection position. Further, a heat sink 242 is provided on the top of the contacting part 227. Fixation of the heat sink 247 to the contacting part 227 may be effected by, for example, bonding with an adhesive, sticking with a heat-conductive tape, or glueing with a gelatinous material such as silicone.

With the arrangement of the fifth embodiment, when the module 100 is in the connection position, heat of the semiconductor chips 120 is transmitted via the contacting part 227 to the heat sink 242 and heat dissipation will be accelerated. As a result, the semiconductor chips 120 will be cooled and their operation will be maintained stably.

Figure 14:
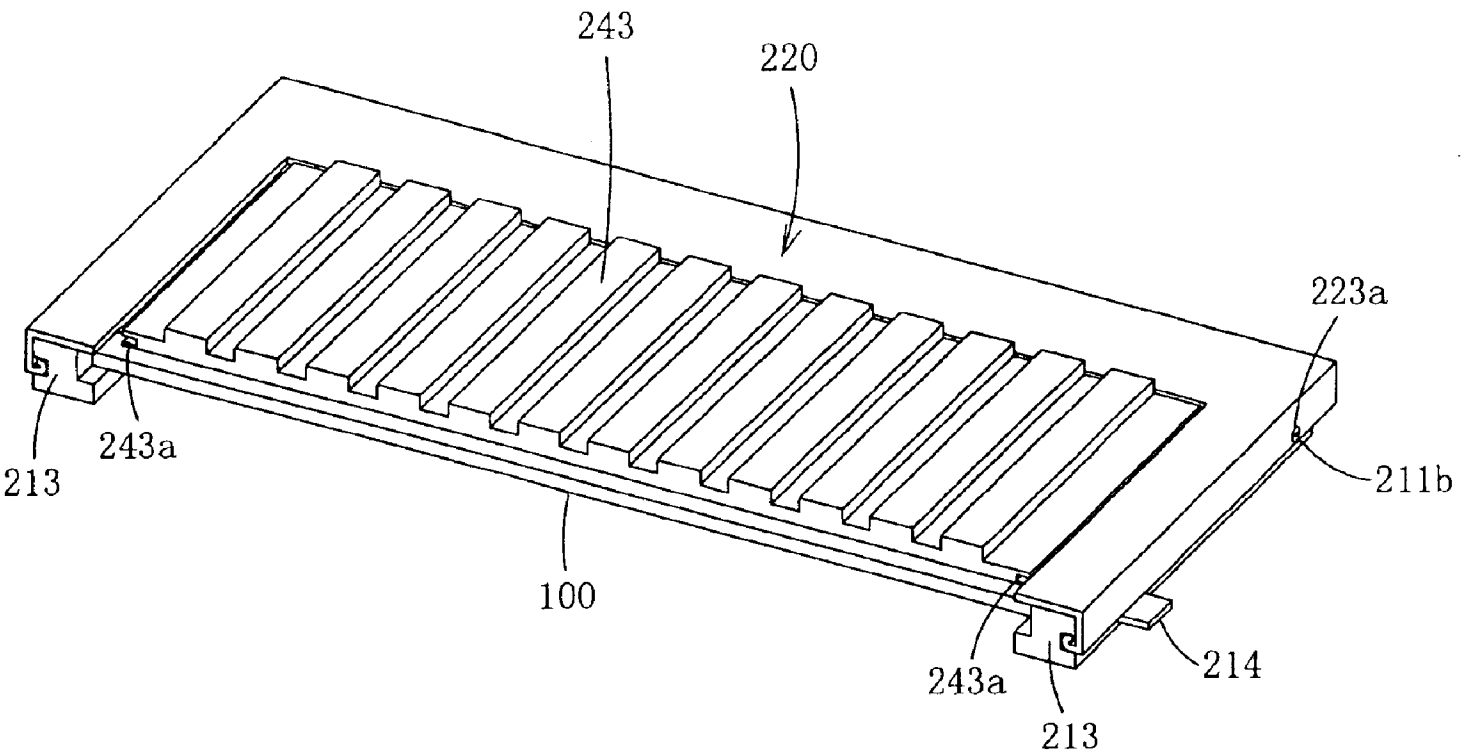
FIG. 14 is a perspective view showing the sixth embodiment of the connector with a module fitted.
Figure 15:
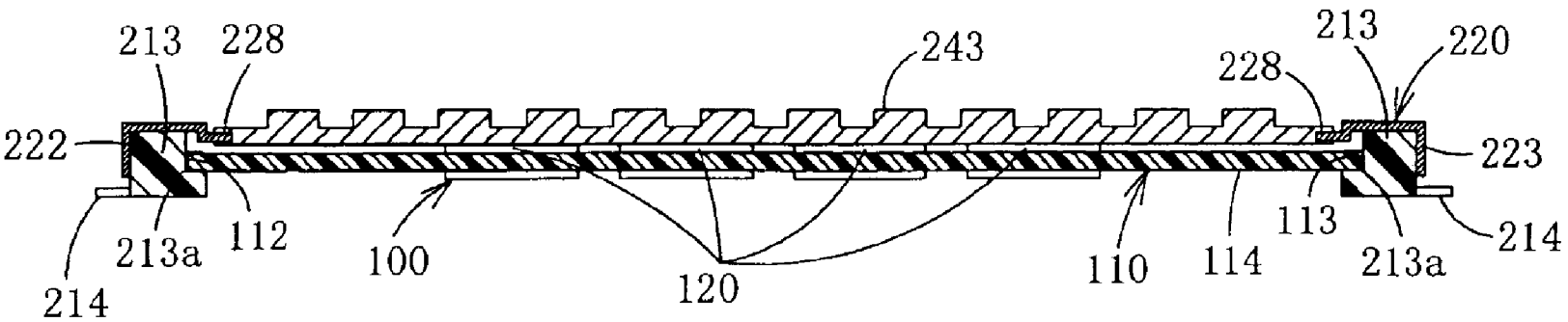
FIG. 15 is a sectional view of the sixth embodiment of the connector with the module fitted.
Figure 16:
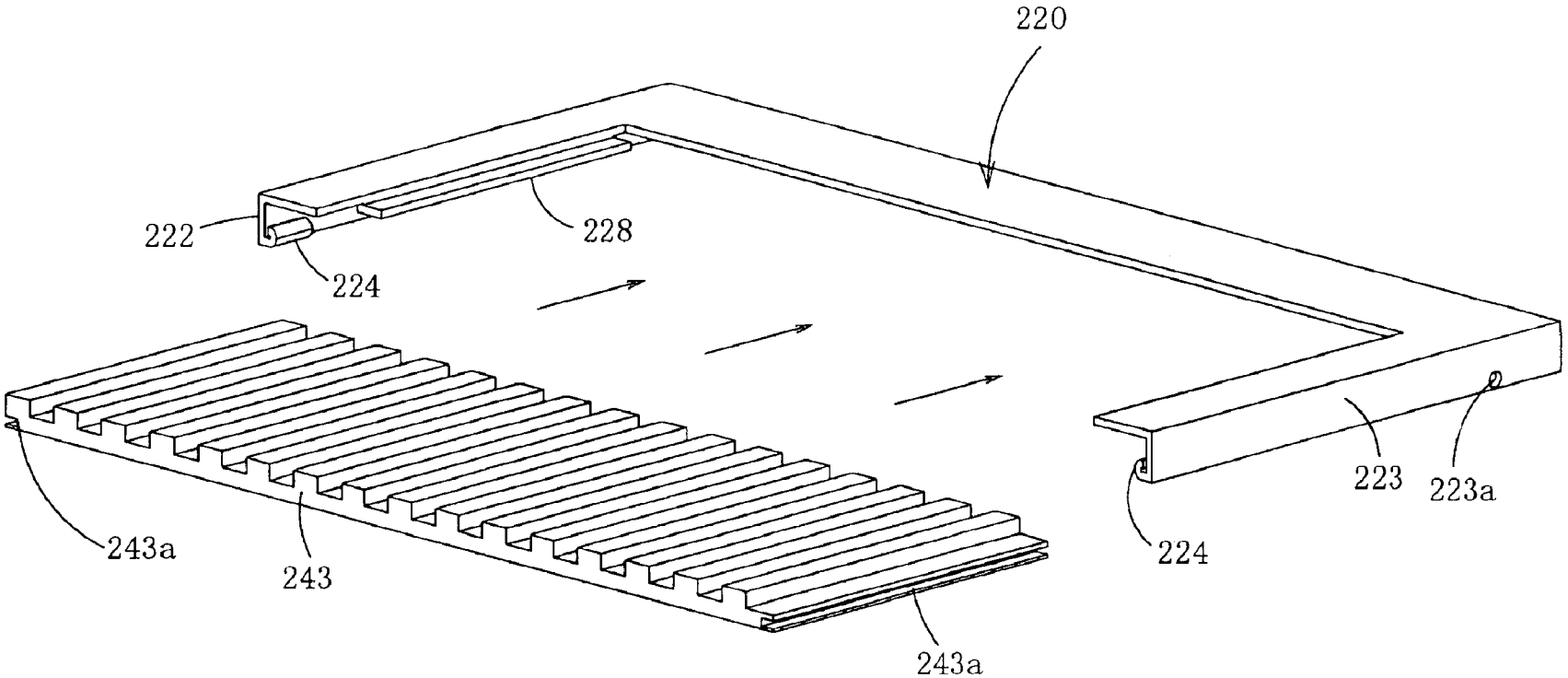
FIG. 16 is a perspective view showing that a heat sink is being assembled with the metallic cover of the sixth embodiment of the connector.

FIG. 14 and FIG. 15 show the sixth embodiment. In this sixth embodiment, a window 225 is opened in the metallic cover 220. The window exposes the semiconductor chips 120 of the module 100 being in the connection position. A heat sink 243, which will contact the above-mentioned semiconductor chips 120 in this window, is connected to the metallic cover 220. In this embodiment, guide rails 228, which extend in the front-rear direction at a constant width, are fixed at their outer edges to the left inner edge and the right inner edge of the window, respectively. The inner edges of the guide rails 228 are fitted into grooves 243*a*, which are formed along in the front-rear direction in the left side face and the right side face of the heat sink 243. Fitting the heat sink 243 onto the metallic cover 220 and removing the heat sink 243 from the metallic cover 220 are effected by sliding the heat sink 243 in the front-rear direction as shown in FIG. 16.

With the arrangement of the sixth embodiment, when the module 100 is in the connection position, heat of the semiconductor chips 120 is transmitted to the heat sink 241 and heat dissipation is accelerated. As a result, the semiconductor chips 120 will be cooled and their operation will be maintained stably. As the heat sink 243 can be connected to or disconnected from the metallic cover 220 by sliding the heat sink 243 in the front-rear direction, the sixth embodiment is useful when the heat sink 243 is to be used in such a way that it is connected or disconnected as required. As for the shield function, an effect similar to that of the second embodiment can be exhibited.

Figure 17:
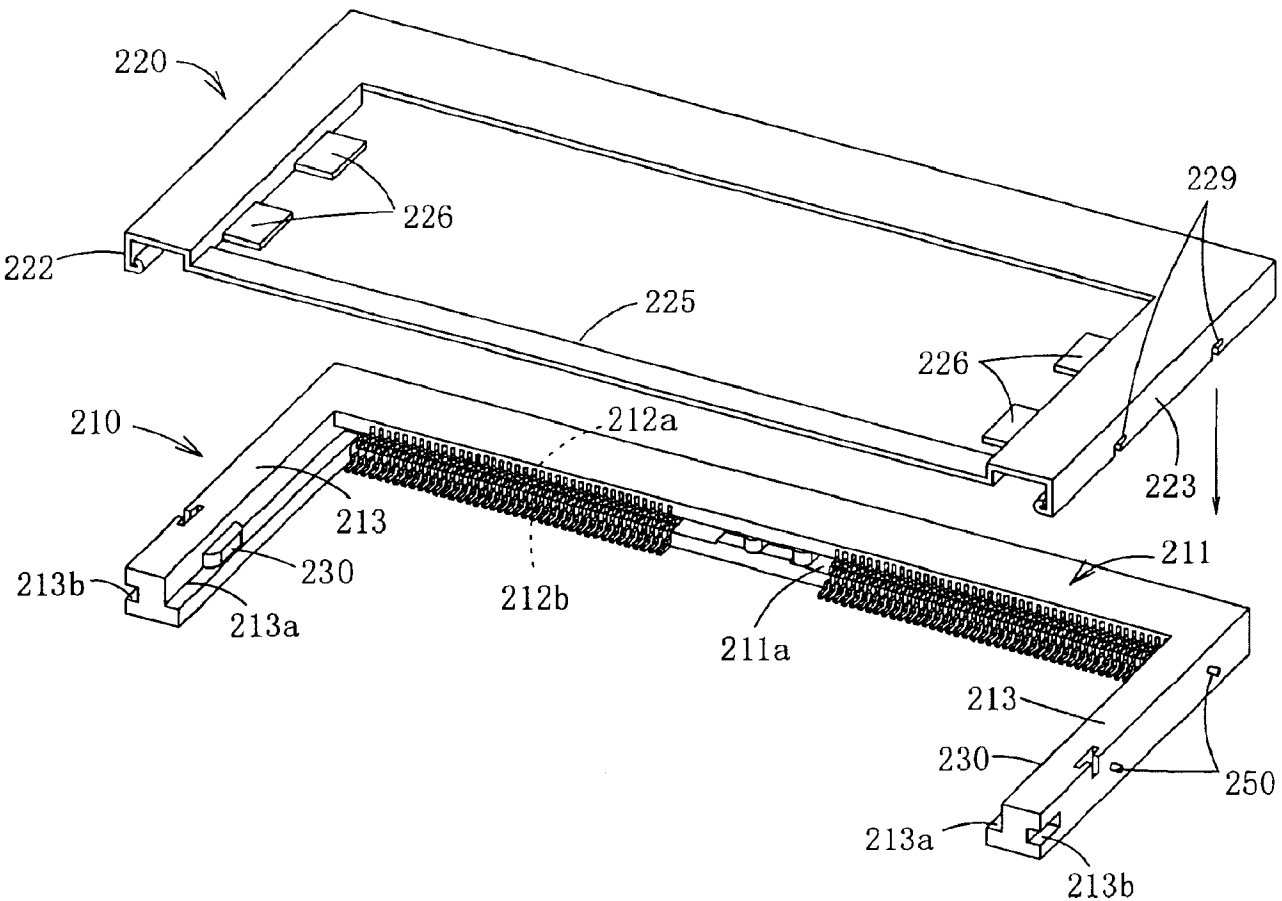
FIG. 17 is an exploded perspective view of the seventh embodiment of the connector.
Figure 18B:
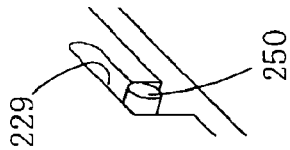
FIG. 18A and FIG. 18B show the connector body of the seventh embodiment of the connector with its metallic cover covering the connector body.
Figure 18A:
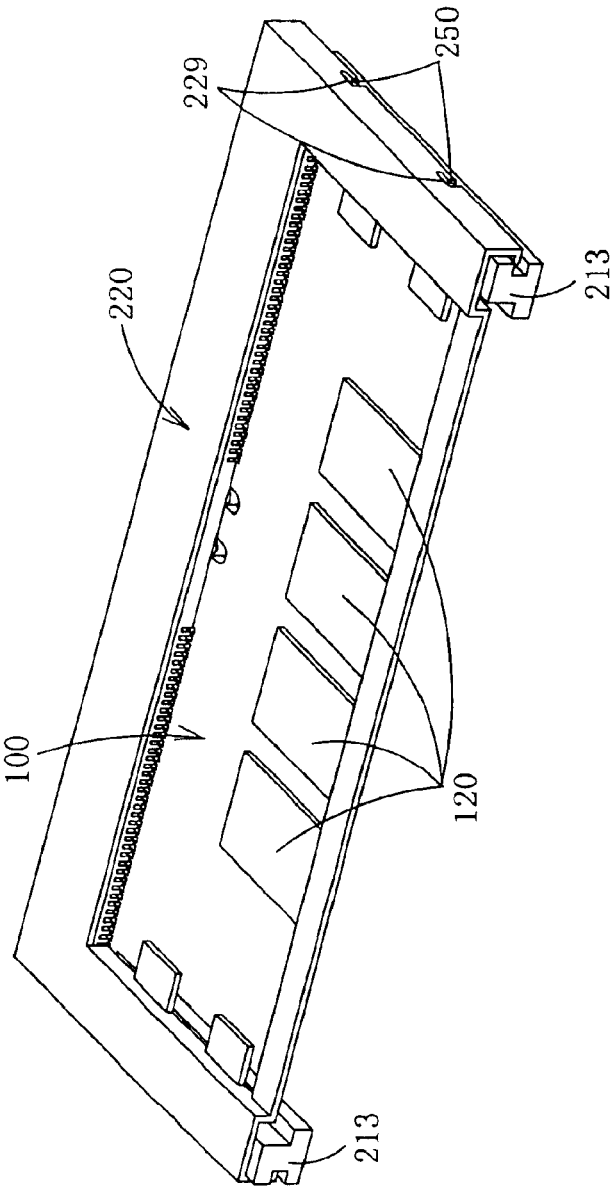
Figure 19B:
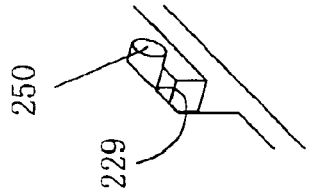
FIG. 19A and FIG. 19B show the connector body of the seventh embodiment of the connector and the metallic cover being engaged to the connector body.
Figure 19A:
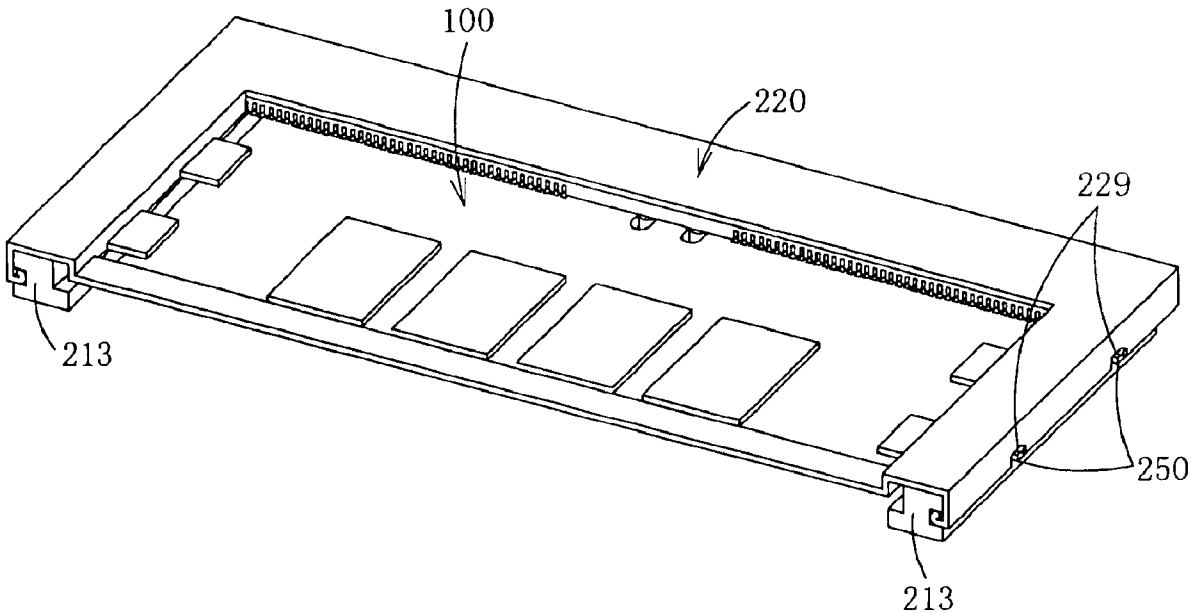

FIG. 17 shows the seventh embodiment. In this seventh embodiment, the metallic cover 220 is not hinged to the receiving part 211, and the metallic cover 220 is removably provided to the connector body 210. Inverted-L-shaped guide grooves 229 are formed from the bottoms in the left side supporting part 222 and the right side supporting part 223 of the metallic cover 220, respectively. The connector body 210 is provided with protrusions 250 of which thickness corresponds to the width of the guide grooves 229. To put the metallic cover 220 over the connector body 210 and engage the cover 220 to the connector body 210, as shown in FIG. 18A and FIG. 18B, the protrusions 250 are guided into the guide grooves 229. Then as shown in FIG. 19A and FIG. 19B, the metallic cover 220 is slid in the front-rear direction (rearwards in the diagram) so as to guide the ends of the guide grooves 229 to the protrusions 250. This completes the engagement. To undone the engagement of the metallic cover 220 to the connector body 210, first the metallic cover 220 is slid in the front-rear direction (forwards in the diagram) so as to move the ends of the guide grooves away from the protrusions 250. Then the metallic cover 220 is lifted.

With the arrangement of the seventh embodiment, when the metallic cover 220 is removed, contacts 212*a*, 212*b* will be exposed allowing easy visual inspection. Thus insertion of the module 100 can be done with ease.

Figure 20:
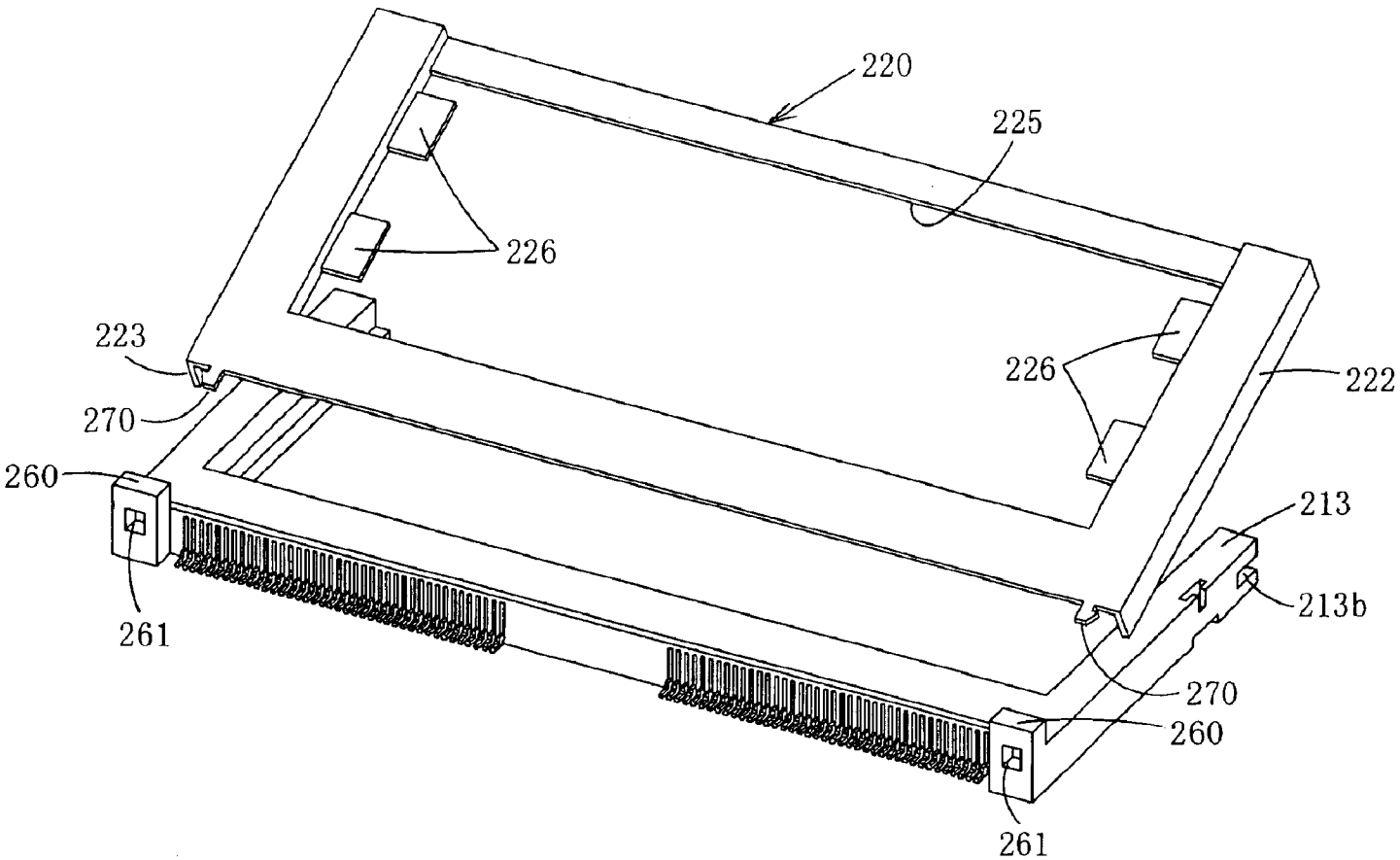
FIG. 20 is a perspective view showing the eighth embodiment of the connector. Prongs of the metallic cover are being put into holes in the stopping wall.
Figure 21:
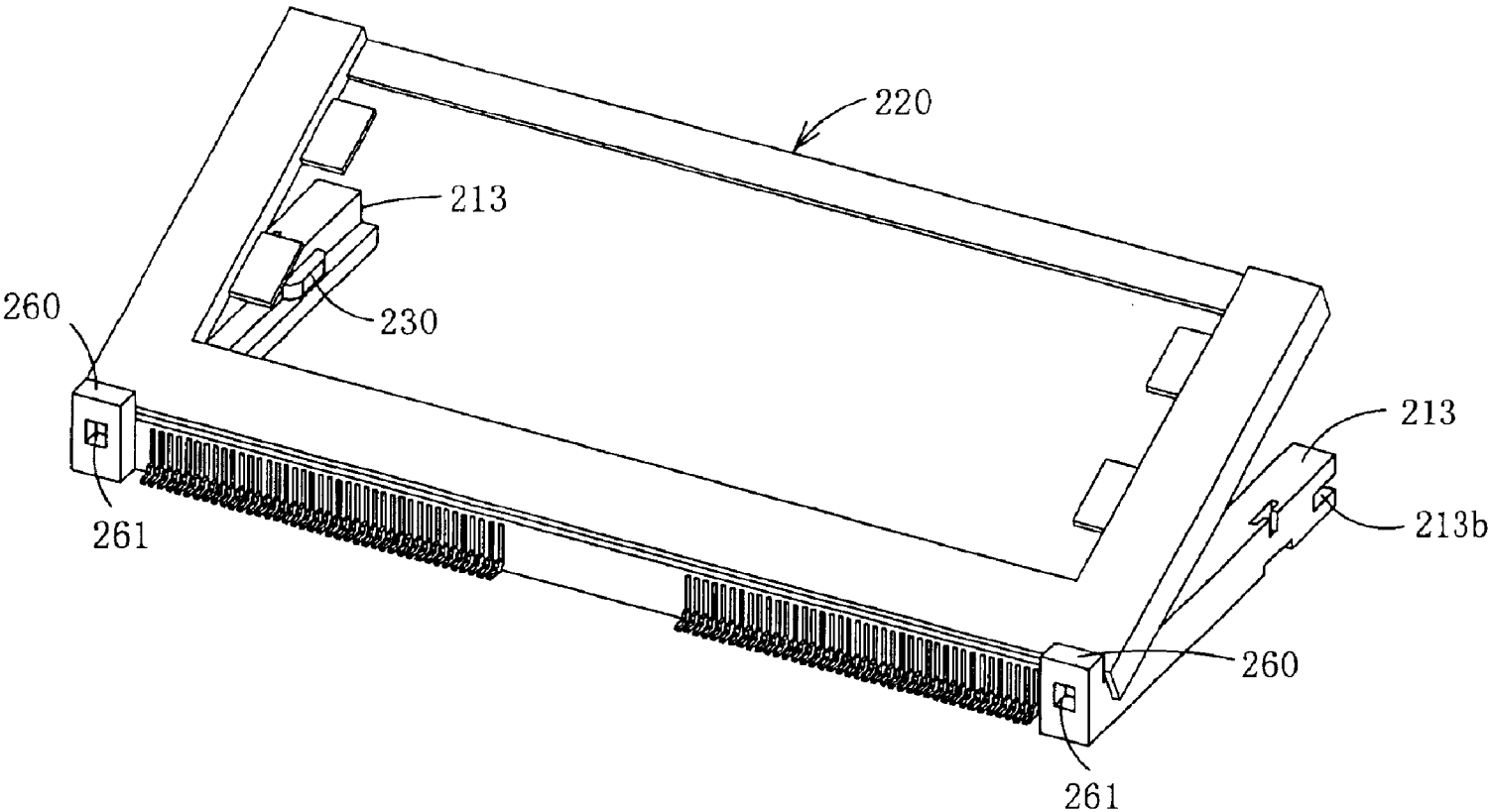
FIG. 21 is a perspective view showing the eighth embodiment of the connector. Prongs of the metallic cover are in the holes of the stopping wall.
Figure 22:
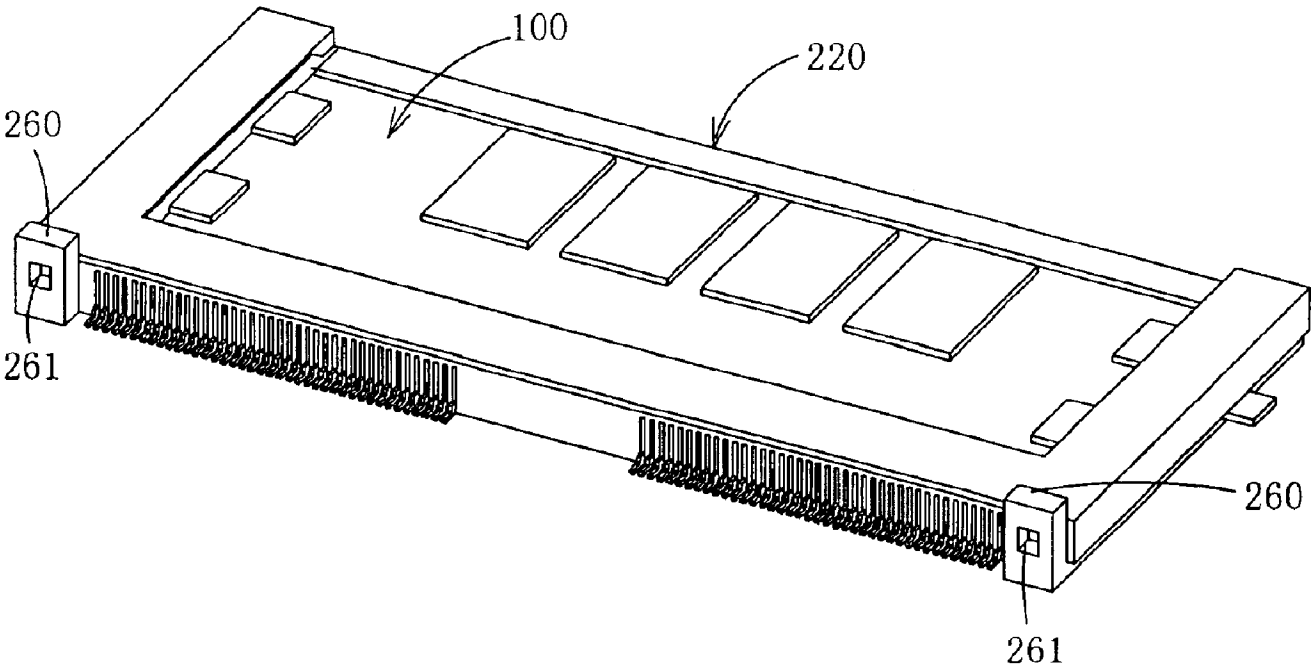
FIG. 22 is a perspective view showing the eighth embodiment of the connector with a module fitted.
Figure 23:
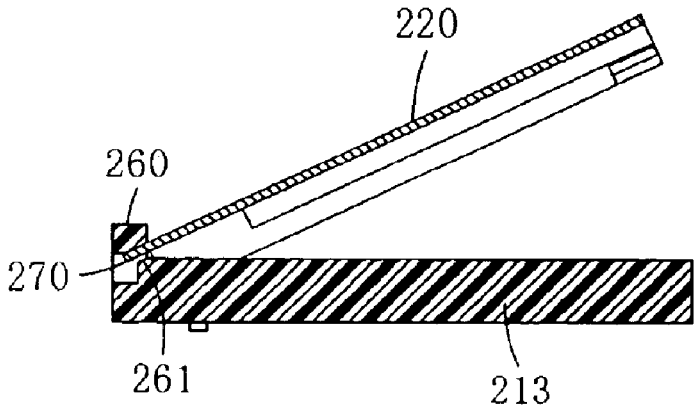
FIG. 23 is a sectional view of the eighth embodiment of the connector with the prongs of the metallic cover being in the holes of the stopping wall along a plane that faces the right and the left.

FIG. 20 shows the eighth embodiment. In this eighth embodiment, the metallic cover 220 is hinged to the receiving part 211 and the metallic cover 200 is removably provided to the connector body 210. Stopping walls 260 are provided at the left and the right of the receiving part 211 to protrude upwards. The stopping walls 260 are provided with holes 261 that are through in the front-rear direction or open at the rear. Protruding protrusions 270 are formed at the left and the right of the front of the metallic cover 220. To put the metallic cover 220 over the connector body 210 and engage the metallic cover 220 to the connector body 210, as shown in FIG. 21 and FIG. 23, the protrusions 270 of the metallic cover 220 are inserted into the holes 261 of the stopping walls 260. As a result, the hinged connections will be completed. After that, like the first embodiment, the module 100 is inserted, and the metallic cover 220 is lowered. Then the module 100 will be kept in the connection position as shown in FIG. 22. When the module 100 is in the insertion/withdrawal position, if the metallic cover 220 is pulled upward and backward, the protrusions 270 of the metallic cover 220 will come out of the holes 261 of the stopping walls 260 and the metallic cover 220 will be disconnected from the connector body 210.

With the arrangement of the eighth embodiment, like the first embodiment, the metallic cover 220 will be engaged to the connector body 210 by lowering the rear end of the metallic cover 220, and the metallic cover 220 will be disconnected from the connector body 210 by lifting the rear end of the metallic cover 220. Thus switchover between the insertion/withdrawal position and the connection position of the module 100 can be done with a single touch. Moreover, when the metallic cover 220 is disconnected, the contacts 212*a*, 212*b* will be exposed allowing easy visual inspection. Thus the insertion of the module 100 can be done with ease.

The present invention includes all embodiments that combine any of the features of the above-mentioned embodiments.

With the description of these embodiments, the first connector for module of the present invention that was described in Summary above has been fully disclosed. With the description of these embodiments, a second connector for module through a seventh connector for module according to the first connector for module that will be described below have been fully substantiated.

A second connector for module according to the first connector for module wherein, the metallic cover is hinged at the front to the receiving part and the rear end of the metallic cover can be lifted. With this arrangement, the metallic cover will be engaged to the connector body when the rear end of the metallic cover is lowered, and the metallic cover will be disconnected from the connector body when the rear end of the metallic cover is lifted. Thus switchover between the insertion/withdrawal position and the connection position of the module can be done easily with a single touch.

A third connector for module according to the first or the second connector for module wherein, the metallic cover is removably provided to the connector body. With this arrangement, when the metallic cover is disconnected, the contact will be exposed allowing easy visual inspection. Thus insertion of the module can be done with ease.

A fourth connector for module according to the first through the third connector for module wherein, the connector body or the metallic cover is provided with a positioning mechanism, which positions the module in the front-rear direction when the module is set into the connection position. With this arrangement, the module can be maintained in the connection position more accurately because the module is positioned in the front-rear direction by the positioning mechanism as well as the module is positioned in the up-down direction by the metallic cover and the bottom of the supporting part and the module is positioned in the left-right direction by the left side and the right side of the supporting part.

A fifth connector for module according to the first through the fourth connector for module wherein, a window is opened in the metallic cover to expose semiconductor chip of the module being in the connection position, and in this window a heat sink that will contact the above-mentioned semiconductor chip is connected to the metallic cover. With this arrangement, when the module is in the connection position, heat of the semiconductor chip will be transmitted to the heat sink and heat dissipation will be accelerated. Thus the semiconductor chip will be cooled and the operation of the chip can be maintained stably.

A sixth connector for module according to the first through the fourth connector for module wherein, the metallic cover is provided with a contacting part that contacts the semiconductor chip of the module being in the connection position and the contacting part is provided with a heat sink. With this arrangement, when the module is in the connection position, heat of the semiconductor chip will be transmitted, via the contacting part, to the heat sink, and heat dissipation will be accelerated. Thus the semiconductor chip will be cooled and the operation of the chip can be maintained stably.

A seventh connector for module according to the first through the sixth connector for module wherein, at least one of the metallic cover and the heat sink covers the conductive member to exhibit the shielding function. The effects of electromagnetic waves, etc. on the connector for module and the module will be reduced and the operation of the circuit can be maintained stably. The conductive member includes a conductor and a semiconductor.

What is claimed is:

1. A connector for a module having a semiconductor chip mounted on a rectangular board and a conductive pad on a front side of the board, the connector connecting the module to a printed circuit board in a position wherein a plane of the board is substantially parallel to the printed circuit board, said connector comprising:

a connector body having a receiving part that extends along the front side of the module being in a connection position, and a groove provided in a rear face thereof into which the front side of the module is inserted, said groove having contacts provided therein which contact the conductive pad on both a top surface and a bottom surface of the module when the module is placed in an insertion/withdrawal position while allowing the pad to shift in a direction of insertion/withdrawal when the module is in the insertion/withdrawal position in which the rear side of the module is at a higher level than in the connection position, and a pair of lateral supporting parts that extend from the receiving part to support a left side, a right side and a bottom of the module in the connection position; and a metallic cover including a first connection means for pivotably connecting said metallic cover to said receiving part of said connector body and a second connection means for connection to said lateral supporting parts, said metallic cover adapted to engage the connector body to sandwich the module between said metallic cover and the supporting part to thereby maintain the module in the connection position, wherein said lateral supporting parts each include a stepped part formed on an inner side thereof for supporting the side and bottom faces of the module, and a slotted portion formed on an outer side thereof for receiving said second connection means of said metallic cover.

2. A connector for module according to claim 1 wherein said metallic cover is hinged at the front to the receiving part and the rear end of the metallic cover can be lifted.

3. A connector for module according to claim 2 wherein said metallic cover is removably provided to the connector body.

4. A connector for module according to claim 2 wherein at least one of said connector body and said metallic cover is provided with a positioning mechanism that positions the module in a front-rear direction when the module is set into the connection position.

5. A connector for module according to claim 4 wherein a window is provided in said metallic cover to expose the semiconductor chip of the module being in the connection position, and in this window a heat sink that will contact said semiconductor chip is connected to the metallic cover.

6. A connector for module according to claim 5 wherein at least one of said metallic cover and said heat sink covers said contacts and the conductive pad to exhibit a shielding function against electromagnetic waves.

7. A connector for module according to claim 4 wherein sad metallic cover is provided with a contacting part that contacts the semiconductor chip of the module being in the connection position, and the contacting part is provided with a heat sink.

8. A connector for module according to claim 7 wherein at least one of said metallic cover and said heat sink covers said contacts and the conductive pad to exhibit a shielding function against electromagnetic waves.

9. A connector for module according to claim 3 wherein at least one of said connector body and said metallic cover is provided with a positioning mechanism that position the module in a front-rear direction when the module is set in connection position.

10. A connector for module according to claim 9 wherein a window is provided in said metallic cover to expose the semiconductor chip of the module being in the connection position, and in this window a heat sink that will contact said semiconductor chip is connected to the metallic cover.

11. A connector for module according to claim 10 wherein at least one of said metallic cover and said heat sink covers said contacts and the conductive pad to exhibit a shielding function against electromagnetic waves.

12. A connector for module according to claim 9 wherein said metallic cover is provided with a contacting part that contacts the semiconductor chip of the module being in the connection position, and the contacting part is provided with a heat sink.

13. A connector for module according to claim 12 wherein at least one of said metallic cover and said heat sink covers said contacts and the conductive pad to exhibit a shielding function against electromagnetic waves.

14. A connector for module according to claim 1 wherein said metallic cover is removably provided to the connector body.

15. A connector for module according to claim 14 wherein at least one of said connector body and said metallic cover is provided with a positioning mechanism that positions the module in a front-rear direction when the module is set into the connection position.

16. A connector for module according to claim 15 wherein a window is provided in said metallic cover to expose the semiconductor chip of the module being in the connection position, and in this window a heat sink that will contact said semiconductor chip is connected to the metallic cover.

17. A connector for module according to claim 16 wherein at least one of said metallic cover and said heat sink covers said contacts and the conductive pad to exhibit a shielding function against electromagnetic waves.

18. A connector for module according to claim 15 wherein said metallic cover is provided with a contacting part that contacts semiconductor chip of the module being in the connection position, and the contacting part is provided with a heat sink.

19. A connector for module according to claim 18 wherein at least one of said metallic cover and said heat sink covers said contacts and the conductive pad to exhibit a shielding function against electromagnetic waves.

20. A connector for a module having a semiconductor chip mounted on a rectangular board and a conductive pad on a front side of the board, the connector connecting the module to a printed circuit board in a position wherein a plane of the board is substantially parallel to the printed circuit board, said connector comprising:

a connector body having a receiving part that extends along the front side of the module being in a connection position, and a groove provided in a rear face thereof into which the front side of the module is inserted, said groove having contacts provided therein which contact the conductive pad on both a top surface and a bottom surface of the module when the module is placed in an insertion/withdrawal position while allowing the pad to shift in a direction of insertion/withdrawal when the module is in the insertion/withdrawal position in which the rear side of the module is at a higher level than in the connection position, and a pair of supporting parts that extend from the receiving part to support a left side, a right side and a bottom of the module in the connection position;

a metallic cover that is adaptable to engage with the connector body to sandwich the module between said metallic cover and the supporting parts to thereby maintain the module in the connection position, said metallic cover including a window for exposing the semiconductor chip when the module is placed in the connection position, and a heat sink secured to said metallic cover and contacts the semiconductor chip to dissipate heat therefrom, at least one of said metallic cover and said heat sink covering said contacts and the conductive pad to exhibit a shielding function against electromagnetic waves, wherein said supporting parts each include a stepped part formed on an inner side thereof for supporting side and bottom faces of the module, and a slotted portion formed on an outer side thereof for receiving said metallic cover.

* * * * *